US007661837B1

(12) United States Patent
Pever et al.

(10) Patent No.: US 7,661,837 B1
(45) Date of Patent: Feb. 16, 2010

(54) DECK LIGHTING SYSTEM

(75) Inventors: Steve E. Pever, Bellefontaine, OH (US); Timothy C. Rothwell, Dublin, OH (US)

(73) Assignee: The Crane Group Companies Limited, Columbus, OH (US)

( * ) Notice: Subject to any disclaimer, the term of this patent is extended or adjusted under 35 U.S.C. 154(b) by 0 days.

(21) Appl. No.: 12/049,929

(22) Filed: Mar. 17, 2008

(51) Int. Cl.
*F21S 8/00* (2006.01)

(52) U.S. Cl. ..... 362/152; 256/1

(58) Field of Classification Search ..... 256/1, 256/65.14, DIG. 5
See application file for complete search history.

(56) References Cited

U.S. PATENT DOCUMENTS

| | | | | |
|---|---|---|---|---|
| 2,657,367 | A | 10/1953 | Brooks | |
| 2,721,255 | A | 10/1955 | Lanmon | |
| 2,742,549 | A | 4/1956 | Peters | |
| 3,448,257 | A | 6/1969 | Sackett, Jr | |
| 4,080,034 | A | 3/1978 | Werner | |
| 4,270,830 | A | 6/1981 | Brenner | |
| 4,648,675 | A | 3/1987 | Gaines | |
| 4,888,669 | A | 12/1989 | Hanson | |
| 4,951,184 | A | 8/1990 | Makurof | |
| 5,001,611 | A | 3/1991 | Beachy et al. | |
| 5,007,855 | A | 4/1991 | O'Brien et al. | |
| 5,057,979 | A | 10/1991 | Carson et al. | |
| 5,429,530 | A | 7/1995 | Zander et al. | |
| 5,493,825 | A | 2/1996 | Gaston | |
| 5,601,279 | A * | 2/1997 | Schwartz et al. | 256/66 |
| 5,642,934 | A | 7/1997 | Haddad | |
| 5,658,071 | A | 8/1997 | Kelpin | |
| 5,701,236 | A * | 12/1997 | Viviano | 362/576 |
| 5,887,856 | A * | 3/1999 | Everly, II | 256/1 |
| 6,004,154 | A | 12/1999 | O'Brien | |
| 6,425,676 | B1 | 7/2002 | Lyons | |
| 6,467,928 | B2 | 10/2002 | Crelin | |
| 6,505,950 | B1 * | 1/2003 | Natoli et al. | 362/146 |
| 6,585,398 | B1 * | 7/2003 | Haddad | 362/328 |
| 6,742,748 | B1 | 6/2004 | Gretz | |
| 6,779,907 | B2 | 8/2004 | Beadle | |
| 6,941,715 | B2 | 9/2005 | Potter | |
| 7,021,786 | B1 | 4/2006 | Sandor, Sr. | |
| 7,036,960 | B1 | 5/2006 | Gretz | |
| 2002/0191391 | A1 | 12/2002 | Van Etten | |
| 2004/0095772 | A1 | 5/2004 | Hoover et al. | |
| 2005/0128758 | A1 | 6/2005 | Brick | |

(Continued)

OTHER PUBLICATIONS

ELIGHTS.COM, Progress P8651 Quick Connector Landscape Accessory, printed May 8, 2008, 1 page, http://www.elights.com/p8651.html.

(Continued)

*Primary Examiner*—Jong-Suk (James) Lee
*Assistant Examiner*—Julie A Shallenberger
(74) *Attorney, Agent, or Firm*—Standley Law Group LLP

(57) ABSTRACT

A lighting system and method for illuminating a deck area. The wiring for the lighting system is hidden from view, providing a more aesthetically pleasing appearance. Furthermore, the lighting system can be installed simultaneously with the deck itself, or afterwards. The system has several embodiments of illumination including post lights, baluster lights, and stair lights. Embodiments of the lighting system may be optionally be installed by the end user and do not require professional design and installation, thus providing a more cost effective solution.

20 Claims, 3 Drawing Sheets

U.S. PATENT DOCUMENTS

2005/0213316 A1* 9/2005 Inman et al. ..... 362/152

OTHER PUBLICATIONS

ELIGHTS.COM, Kichler 15509 Quic Disc Low Voltage Cable Connector, printed May 8, 2008, 1 page, http://www.elights.com/quic-con.html.

Hadco, Connector (LVC3), printed May 8, 2008, 1 page, http://www.hadco.com/hadco/Public/ProductDetail.aspx? pid=1149&Id=16.

Hadco, Connector (LVC4), printed May 8, 2008, 1 page, http://www.hadco.com/hadco/Public/ProductDetail.aspx?pid=1150&Id=16.

* cited by examiner

DECK LIGHTING SYSTEM

BACKGROUND AND SUMMARY OF THE INVENTION

Embodiments of the present invention relate generally to lighting systems and methods such as for outdoor deck areas, for lighting purposes as well as decorative purposes, and also to a method of wiring the lighting area.

Outdoor deck areas are very popular as they add to the beauty of the home as well as provide a functional place to enjoy the outdoors. However, many decks do not have sufficient lighting such that they can be enjoyed during the night time as well as the day time. Furthermore, the decks that currently employ lighting systems may run the wiring on the surface of the posts, railings, and deck surface, providing a look that is not aesthetically pleasing.

Exemplary embodiments of the present invention may provide a lighting system for an outdoor deck area that provides sufficient lighting while at the same time adding to the aesthetic value of the area. Exemplary embodiments of the present invention may substantially hide the wiring from view. In some examples, the light housings may be incorporated into or effectively use the deck materials.

Exemplary embodiments of the present invention may provide a lighting system that may be built specifically with the deck, including the deck surface, railings, and posts, to provide a total deck experience. For example, the deck may not need to be torn up and rearranged to put in the lighting system. Instead, the deck may be manufactured to allow easy installation of the lighting system.

Exemplary embodiments of the present invention may provide features that are affordable to the average homeowner. This means that the lighting system may not have to be tailor-made for every home, but may easily be manufactured at a high rate and may be installed at any home easily. Also, exemplary embodiments may not need to be installed by a specialized carpenter, but instead may easily be installed by the homeowner, if desired. In this way, cost may be minimized.

Different embodiments of the lighting system may employ any combination of various types of lights including, but not limited to, post lights, baluster lights, and stair riser lights. For example, post lights may be found at the top of posts (e.g., below post caps) or along the lengths or sides of posts. In some exemplary embodiments, baluster lights may be provided in association with the balusters. As a further example, stair riser lights may be found on the stairs, such as on the stair riser boards. Various other locations may also be possible.

In addition to the novel features and advantages mentioned above, other benefits will be readily apparent from the following descriptions of the drawings and exemplary embodiments.

DETAILED DESCRIPTION OF EXEMPLARY EMBODIMENT(S)

Figure 1:
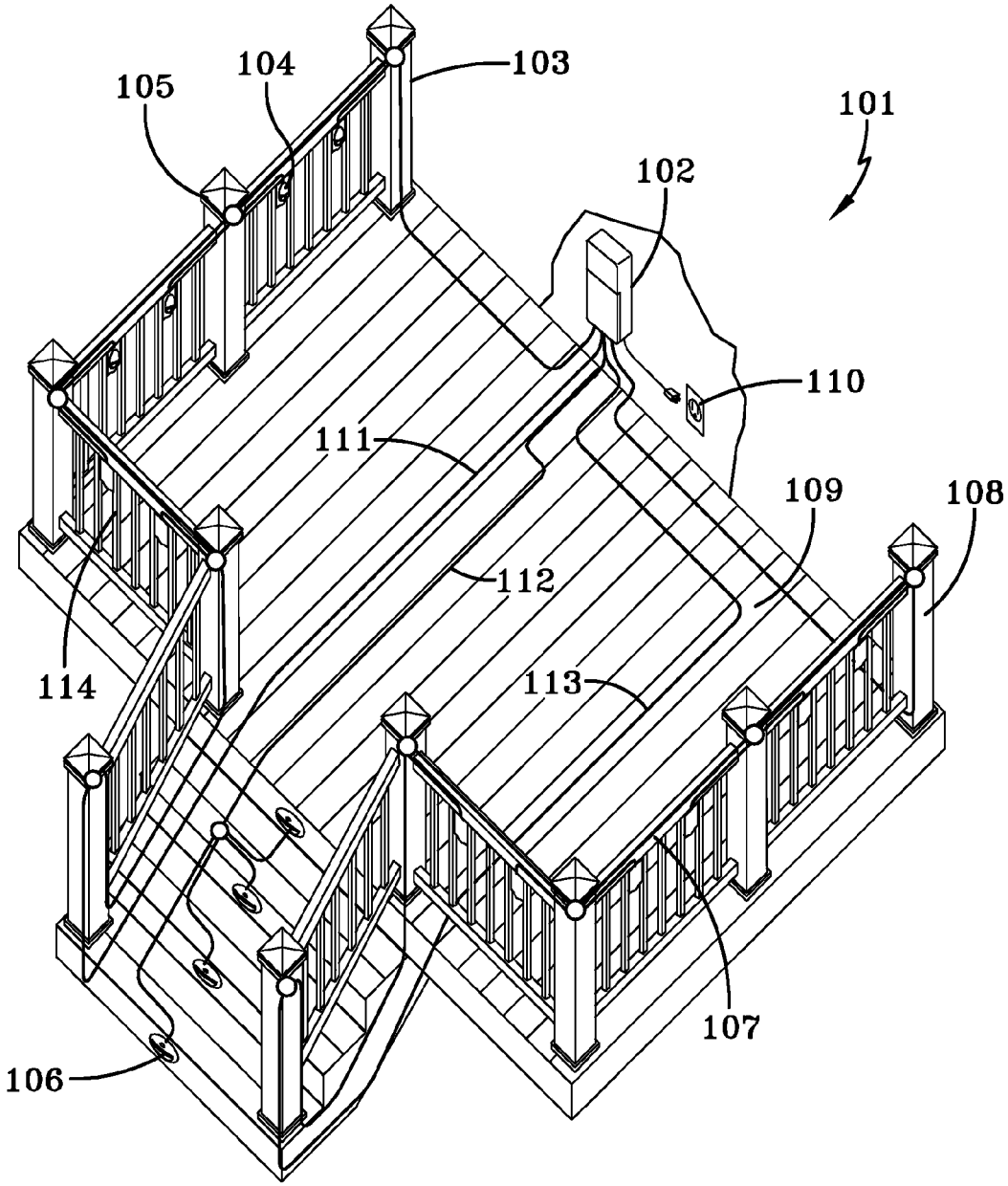
FIG. 1 is an illustration of an exemplary embodiment of a lighting system including post lights, baluster lights, and stair riser lights.

FIG. 1 is an illustration of an exemplary embodiment of the lighting method and system as well as the placement of the post lights 105, the baluster lights 104, and the stair riser lights 106. The deck system 101 is comprised of posts 103 with post covers 108, rails with rail covers 107, balusters 114, and the deck surface 109. The deck surface 109, post 103, post covers 108, and rails with rail covers 107 may be made from well known materials such as, but not limited to, wood, plastic, wood composites and/or metal. Post lights 105 are shown at each of the posts 103 in the figure, but the post lights 105 may be placed at all the posts, some of the posts, or none of the posts depending on the user's preference. Baluster lights 104 are shown in between the second and third balusters from each of the posts 103, but they may be placed in between any, all, or no balusters 114. Stair riser lights 106 are shown on the stair assembly and these lights can also be placed on every stair, every other stair, or wherever the user prefers.

The wiring connects to the transformer 102 which is shown as plugged into the Outdoor GFCI Outlet 110. Although embodiments of the present invention may include a separate solar power source for the deck lighting. The wiring may be comprised of two loops 111 and 113 as well as a non-loop 112 running to the stair riser lights 106. For ease of viewing, the wiring is shown on the surface of the deck, but in an exemplary embodiment the wiring preferably runs underneath the deck surface 109, up the posts 103, but beneath post covers 108, and along rails, but beneath rail covers 107.

Figure 2A:
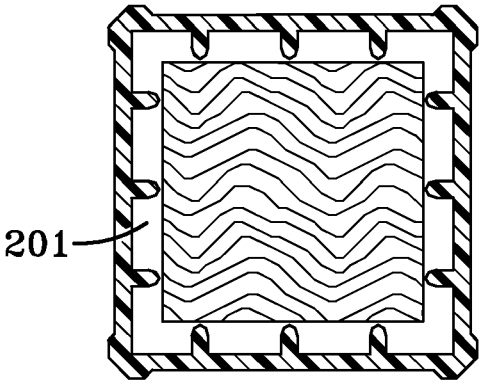
FIGS. 2A and 2B are top plan views of two posts with different embodiments of post covers attached.
Figure 2B:
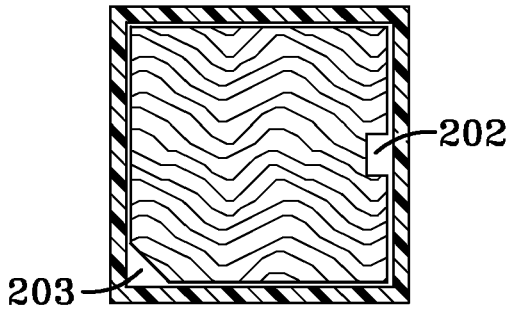

FIGS. 2A and 2B are top views of two posts with different embodiments of post covers attached. The space between the post and the post cover provides a channel for the wiring to travel within. In FIG. 2A, space 201 is creating by an offset in the post cover. In FIG. 2B, space 202 is created by removing a slot of material down the side of the post. Also in FIG. 2B, space 203 is created by chamfering the edge of the post. The spaces 201, 202, and 203 are not necessary to practice the present invention, but they are helpful as they facilitate the installation of the wiring, and also prevent the wires from being damaged.

Figure 3:
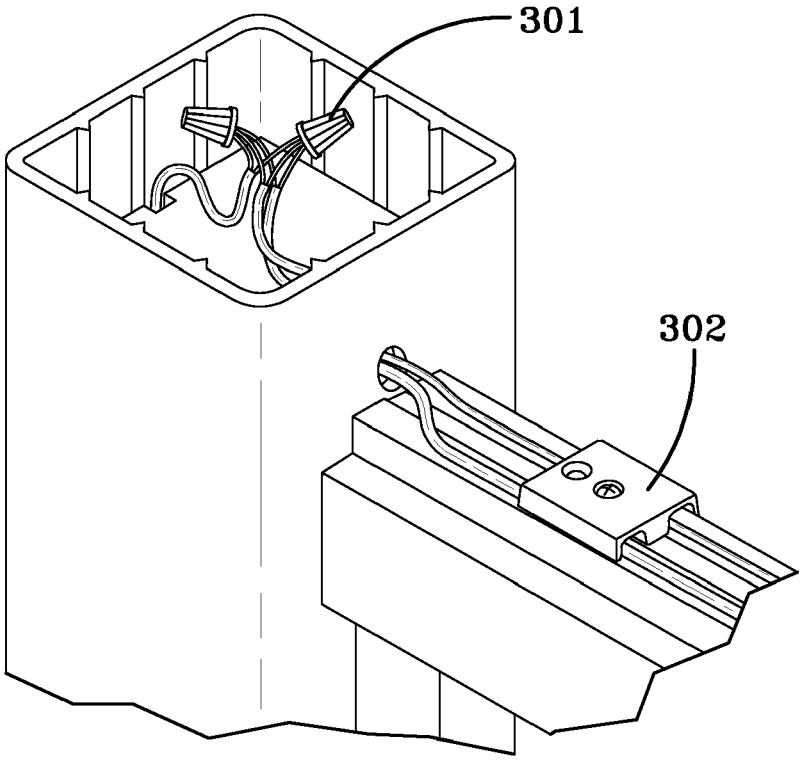
FIG. 3 is a perspective view of an exemplary embodiment of a post/post cover assembly and an attached rail (rail cover not shown for clarity).

FIG. 3 is a close-up view of one of the posts with a post cover attached, and a rail cover off. Wire nuts 301 are used to create the connections between the wires, and wire guides 302 are used to guide the wires along the rails.

Figure 4A:
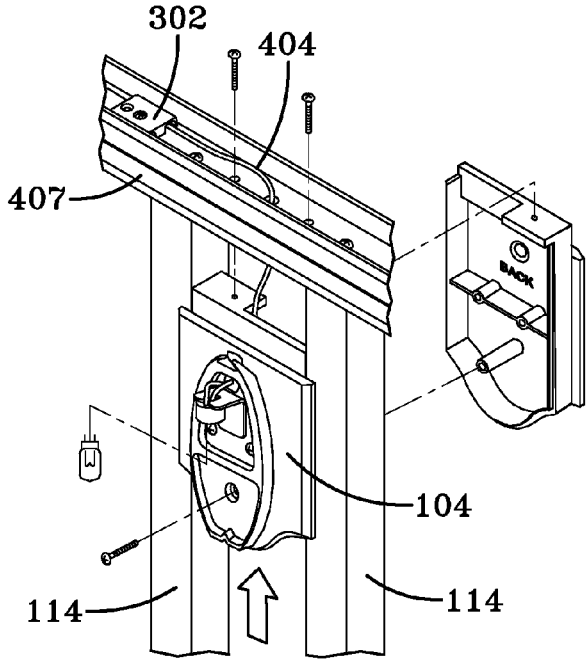
FIGS. 4A-4D are illustrations of various embodiments of lights and associated assemblies.
Figure 4C:
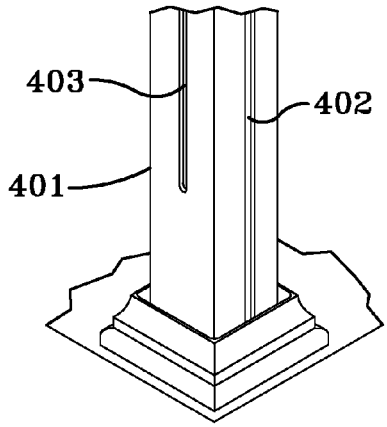
Figure 4B:
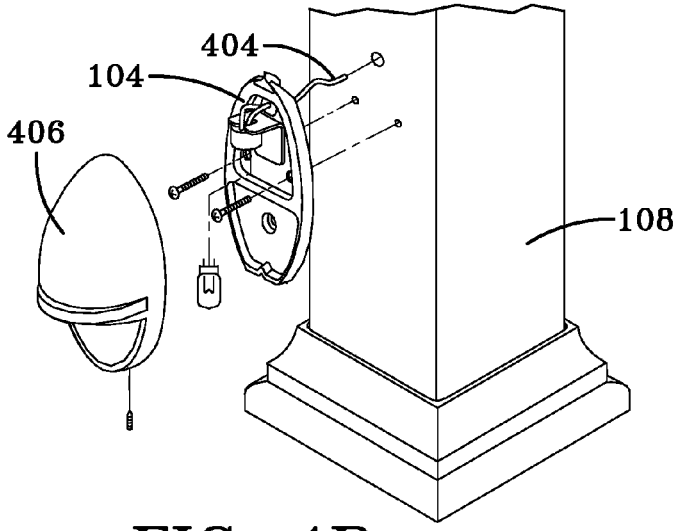

FIGS. 4A-4D are illustrations illustration of two different embodiments of lights 104 and their associated attachment systems. FIG. 4A shows light 104 being installed below a rail 407 and in between two balusters 114. In this embodiment, the wiring 404 travels through the wire guides 302 and passes through the rail 407 to reach the baluster light 104. In FIG. 4B, the light 104 is attached to the side of a post cover 108, which is associated with a post 401. FIG. 4C shows, if necessary, a space 403 may be created for the wire 404 to pass between the post 401 and the post cover 108. Also shown is space 402 which may allow a wire to pass from below the deck surface 109 to the top of a post 401. Such as shown in FIG. 2, other spacing is possible.

Figure 4D:
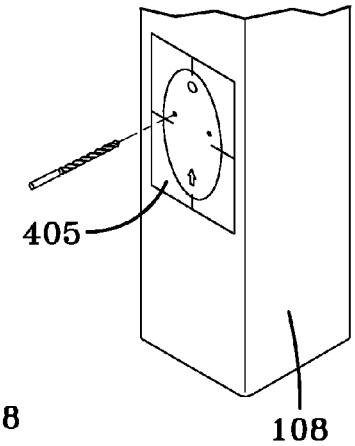

In an exemplary embodiment of the present invention, FIG. 4D shows that a jig 405 may used to determine the proper placement of the baluster light 104 relative to the post cover 108. Referring back to FIG. 4B, the wire 404 passes through the post cover 108 to connect to the baluster light 104. The baluster lamp cover 406 is attached to the lamp to focus the light and shield the lamp components from the elements.

In an exemplary embodiment of the present invention, a jig 405 may used to determine the proper placement of the baluster light 104 relative to the post cover 108. The wire 404 passes through the post cover 108 to connect to the baluster light 104. The baluster lamp cover 406 is attached to the lamp to focus the light and shield the lamp components from the elements.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A method for wiring a lighting system in an area, said method comprising:

providing a first and second post, first and second post covers, a rail, a transformer, and a deck surface;

covering a substantial length of each of said first and second post respectively with said first and second post covers;

attaching said rail to said first and second posts or said first and second post covers;

running a wiring system:

from said transformer to said first post by routing the wire underneath said deck surface and between the first post and the first post cover such that the wire travels within a space defined between an exterior surface of the first post and an interior surface of the first post cover;

to said second post by routing said wire along said rail; and between the second post and the second post cover such that the wire travels within a space defined between an exterior surface of the second post and an interior surface of the second post cover, then underneath the deck surface, and returning to said transformer;

connecting one or more post lights to said posts and said at least one wire; and covering said rail with a rail cover.

2. The method of claim 1, further comprising:

connecting one or more baluster lights to said wire where it passes along said rail; and connecting said baluster lights to said rail.

3. The method of claim 1, further comprising:

connecting one or more baluster lights to said wire where it passes along said posts; and connecting said baluster lights to said posts.

4. The method of claim 1, further comprising:

removing a slot of material down a side of each of said first and second posts; and routing said wire within said slots.

5. The method of claim 1, further comprising:

chamfering a corner of each of said first and second posts; and routing said wire along said chamfered corners.

6. The method of claim 1, further comprising:

providing one or more additional posts, post covers, and rails;

covering a substantial length of each of said additional posts respectively with said additional post covers;

attaching said additional rails to any one of the following: said first post, said second post, and said additional posts;

continuing the running of said wire along said additional rails to connect said additional posts prior to routing the wire underneath the deck surface and back to the transformer;

connecting one or more additional post lights to said wire; and covering a substantial length of each of said additional rails respectively with rail covers.

7. The method of claim 6, further comprising:

connecting one or more baluster lights to said wire where it passes along said additional rails; and connecting said baluster lights to said additional rails.

8. The method of claim 6, further comprising:

connecting one or more baluster lights to said wire where it passes along said additional posts; and connecting said baluster lights to said additional posts.

9. A method for wiring a lighting system in an area, said method comprising:

providing more than one post, more than one post cover, more than one rail, a transformer, a deck surface, and a stair assembly;

covering a substantial length of each of said posts respectively with said post covers;

running a first wire from said transformer to a first post by routing said first wire underneath said deck surface and between the first post and the first post cover such that said first wire travels within a space defined between an exterior surface of the first post and an interior surface of the first post cover;

continuing the running of said first wire to a second post by routing said first wire along a first rail;

continuing the running of said first wire to additional posts by routing said first wire along additional rails;

continuing the running of said first wire between the final post and the final post cover such that said first wire travels within a space defined between an exterior surface of the final post and an interior surface of the final post cover, then underneath the deck surface, and returning to said transformer;

connecting one or more post lights to said first wire;

running a second wire from said transformer to said stair assembly by routing said second wire underneath said deck surface and underneath said stair assembly;

connecting one or more stair lights to said second wire and said stair assembly; and covering a substantial length of each of said rails respectively with said rail covers.

10. The method of claim 9, further comprising:

connecting one or more baluster lights to said first wire where it passes along any one of the following: said first rail and said additional rails; and connecting said baluster lights to any one of the following: said first rail and said additional rails.

11. The method of claim 9, further comprising:

connecting one or more baluster lights to said wire where it passes along any one of the following: said first post, said second post, and said additional posts; and connecting said baluster lights to any one of the following: said first post, said second post, and said additional posts.

12. The method of claim 9, further comprising:

removing a slot of material down a respective side of said first post, said second post, and said additional posts; and routing said first wire within said slots.

13. The method of claim 9, further comprising:

chamfering a respective corner of said first post, said second post, and said additional posts; and routing said first wire along said chamfered corners.

14. The method of claim 9, further comprising electrically connecting said transformer to a GFCI outlet.

15. A system for lighting an area comprising:

a first and second post;

first and second post covers respectively covering a substantial length of each of said first and second posts;

a first and second post light adjacent to the top of said first and second posts;

a rail extending between said first and second posts;

a deck surface;

a transformer;

a wire running from said transformer, underneath said deck surface, between said first post and said first post cover such that said wire travels within a space defined between an exterior surface of said first post and an interior surface of said first post cover, connected to said first post light, running along said rail, connected to said second post light, running between said second post and said second post cover such that said wire travels within a space defined between an exterior surface of said second post and an interior surface of said second post cover, running underneath said deck surface, and returning to said transformer; and a rail cover associated with said rail and covering said wire such that said wire travels within a space defined between an exterior surface of said rail and an interior surface of said rail cover.

16. The system from claim 15 further comprising:

additional posts;

additional post covers respectively covering a substantial length of each of said additional posts;

additional post lights adjacent to the top of said additional posts;

additional rails extending from and between said additional posts such that said additional posts are associated with said first and second posts;

said wire further connects to said additional post lights by running along said additional rails prior to running underneath said deck surface and returning to said transformer; and additional rail covers attached associated with said additional rails and covering said wire such that said wire travels within a respective space defined between an exterior surface of each additional rail and an interior surface of each additional rail cover.

17. The system of claim 15 further comprising:

a respective notch in each of said first and second posts which travels parallel to the length of said first and second posts; and wherein said wire travels within each of said notches.

18. The system of claim 15 further comprising:

a respective chamfer on each of said first and second posts which travels parallel to the length of said first and second posts; and wherein said wire travels along each of said chamfers.

19. The system of claim 15 further comprising:

a stair assembly;

one or more stair lights associated with said stair assembly;

a second wire running from said transformer, underneath said deck surface, and connected to said one or more stair lights.

20. The system of claim 15 further comprising a GFCI outlet electrically connected to said transformer.

* * * * *

UNITED STATES PATENT AND TRADEMARK OFFICE

CERTIFICATE OF CORRECTION

PATENT NO. : 7,661,837 B1
APPLICATION NO. : 12/049929
DATED : February 16, 2010
INVENTOR(S) : Pever et al.

It is certified that error appears in the above-identified patent and that said Letters Patent is hereby corrected as shown below:

In column 6, line 14, please delete "attached".

Signed and Sealed this

Twenty-third Day of March, 2010

David J. Kappos

David J. Kappos
*Director of the United States Patent and Trademark Office*